US010290965B1

(12) United States Patent
Morello et al.

(10) Patent No.: US 10,290,965 B1
(45) Date of Patent: May 14, 2019

(54) SELF-GAPPING ELECTRICAL-TERMINAL

(71) Applicant: Delphi Technologies, LLC, Troy, MI (US)

(72) Inventors: John R. Morello, Warren, OH (US); James M. Rainey, Warren, OH (US)

(73) Assignee: Delphi Technologies, LLC, Troy, MI (US)

( * ) Notice: Subject to any disclaimer, the term of this patent is extended or adjusted under 35 U.S.C. 154(b) by 0 days.

(21) Appl. No.: 15/946,375

(22) Filed: Apr. 5, 2018

(51) Int. Cl.
*H01R 13/11* (2006.01)
*H01R 4/02* (2006.01)
*H01R 4/18* (2006.01)

(52) U.S. Cl.
CPC ..... *H01R 13/11* (2013.01); *H01R 4/023* (2013.01); *H01R 4/187* (2013.01)

(58) Field of Classification Search
CPC ..... H01R 13/11; H01R 13/15; H01R 13/052; H01R 4/023
USPC ..... 439/851–857
See application file for complete search history.

(56) References Cited

U.S. PATENT DOCUMENTS 5,593,328 A * 1/1997 Okada ..... H01R 13/11 439/843
5,601,458 A * 2/1997 Ohsumi ..... H01R 13/187 439/851
5,630,738 A * 5/1997 Ito ..... H01R 13/113 439/851
5,735,717 A * 4/1998 Nabeshima ..... H01R 13/11 439/851
6,527,601 B2 * 3/2003 Chen ..... H01R 13/187 439/851
6,547,608 B2 * 4/2003 Sato ..... H01R 13/11 439/851
8,241,075 B2 * 8/2012 Ishikawa ..... H01R 13/113 439/851

* cited by examiner

*Primary Examiner* — Hien D Vu
(74) *Attorney, Agent, or Firm* — Joseph V. Bonadies

(57) ABSTRACT

An electrical-terminal includes a wire-attachment-end and a connection-end. The wire-attachment-end is configured to receive a wire-cable. The connection-end is opposite the wire-attachment-end. The connection-end has a top-wall, a bottom-wall, a left side-wall, and a right side-wall forming generally a rectilinear-shape and defining a cavity configured to receive a corresponding electrical-terminal inserted along a mating-axis. The connection-end includes an upper contact-frame and a lower contact-frame disposed within the cavity. The lower contact-frame terminates at a tip that is reversed 180-degrees such that the tip is disposed between the lower contact-frame and the bottom-wall. The lower contact-frame defines an inner-contact having a free-end disposed within a perimeter of the lower contact-frame. The lower contact-frame includes opposed-tabs disposed within opposed-windows defined by the left side-wall and the right side-wall. The opposed-tabs engage the opposed-windows when the corresponding electrical-terminal is inserted, thereby inhibiting a deflection of the lower contact-frame.

27 Claims, 6 Drawing Sheets

SELF-GAPPING ELECTRICAL-TERMINAL

TECHNICAL FIELD OF INVENTION

This disclosure generally relates to an electrical-terminal, and more particularly relates to an electrical-terminal with a self-gapping contact-frame.

BRIEF DESCRIPTION OF DRAWINGS

The present invention will now be described, by way of example with reference to the accompanying drawings, in which.

The reference numbers of similar elements in the embodiments shown in the various figures share the last two digits.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
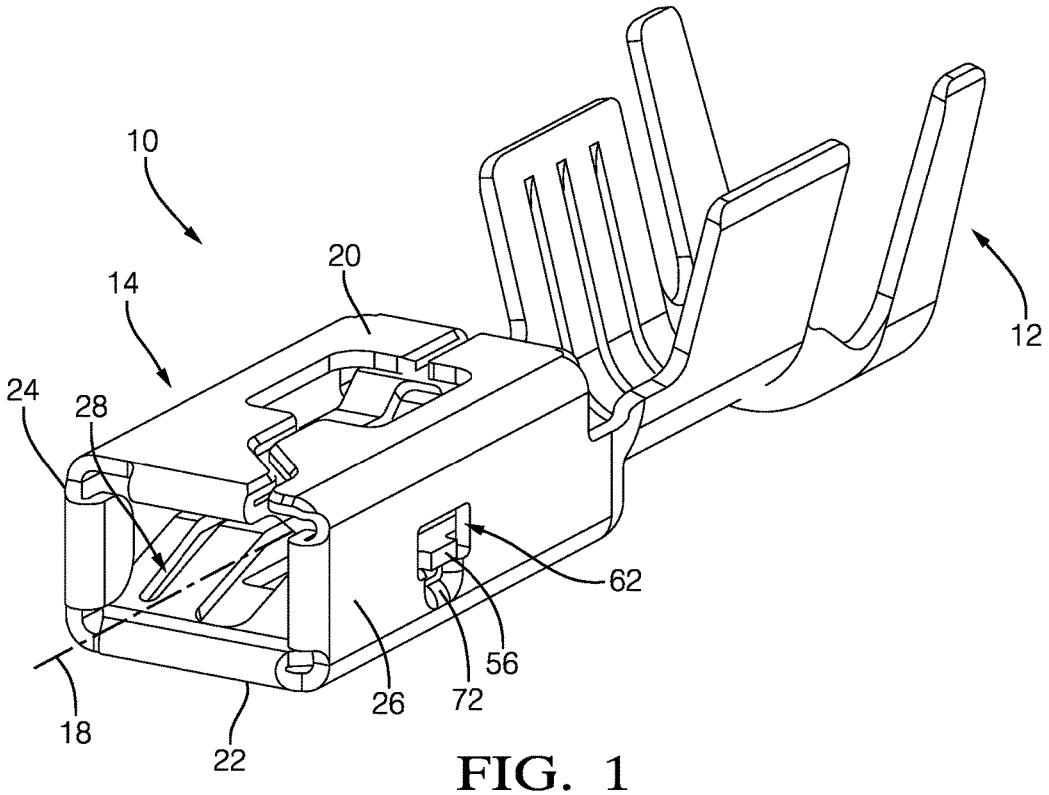
FIG. 1 is an illustration of an electrical-terminal in accordance with one embodiment.

FIG. 1 illustrates an electrical-terminal 10, hereafter referred to as the terminal 10. The terminal 10 is formed from a single sheet of electrically conductive material, such as a copper-based alloy, and may include a conductive coating (e.g., tin, silver, gold, etc.). The terminal 10 includes a wire-attachment-end 12 configured to receive a wire-cable (not shown) that may be a component of a wiring-harness of a vehicle. The wire-cable may be attached to the terminal 10 by any of the known processes, such as crimping and/or welding.

The terminal 10 also includes a connection-end 14 opposite the wire-attachment-end 12 configured to receive a corresponding electrical-terminal 16 (see FIGS. 6A-6B) inserted along a mating-axis 18. The corresponding electrical-terminal 16 is formed from an electrically conductive material, such as a copper-based alloy, and may include a conductive coating (e.g., tin, silver, gold, etc.), and may be attached to another wire-cable that may be another component of the wiring-harness of the vehicle. The connection-end 14 has a top-wall 20, a bottom-wall 22, a left side-wall 24, and a right side-wall 26 forming generally a rectilinear-shape and defining a cavity 28 that receives the corresponding electrical-terminal 16.

Figure 2:
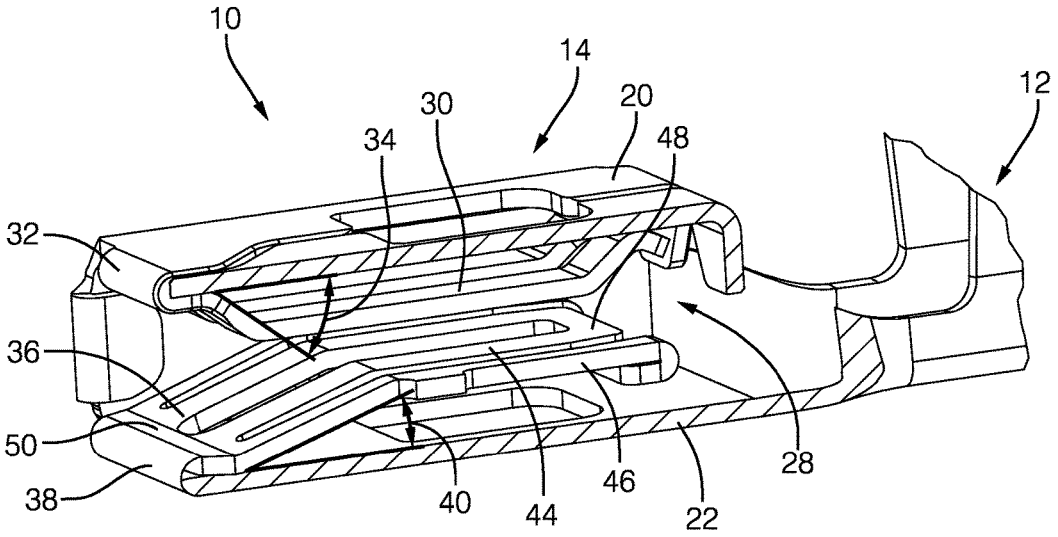
FIG. 2 is a perspective section-view of the electrical-terminal of FIG. 1 in accordance with one embodiment.

FIG. 2 is a perspective section-view of the connection-end 14 of the terminal 10 of FIG. 1 and illustrates components within the cavity 28. The connection-end 14 includes an upper contact disposed within the cavity 28 extending beyond the top-wall 20. The upper contact may be one or more protrusions embossed into the top-wall 20. In the example illustrated in FIG. 2, the upper contact is an upper contact-frame 30 disposed within the cavity 28 and attached to a top leading-edge 32 of the top-wall 20. The upper contact-frame 30 extends along the mating-axis 18 and overlays the top-wall 20. That is, the upper contact-frame 30 is folded back into the cavity 28 to create a spring contact configured to engage one side of the corresponding electrical-terminal 16. The upper contact-frame 30 defines an upper lead-angle 34, configured to guide the corresponding electrical-terminal 16 into the cavity 28, that is characterized as having a range of 30-degrees to 45-degrees.

The connection-end 14 also includes a lower contact-frame 36 disposed within the cavity 28 and attached to a bottom leading-edge 38 of the bottom-wall 22. The lower contact-frame 36 extends along the mating-axis 18 and overlays the bottom-wall 22. That is, the lower contact-frame 36 is folded back into the cavity 28 to create another spring contact configured to engage an opposite side of the corresponding electrical-terminal 16. The lower contact-frame 36 defines a lower lead-angle 40, configured to guide the corresponding electrical-terminal 16 into the cavity 28, that is characterized as having a range of 15-degrees to 30-degrees.

Figure 3:
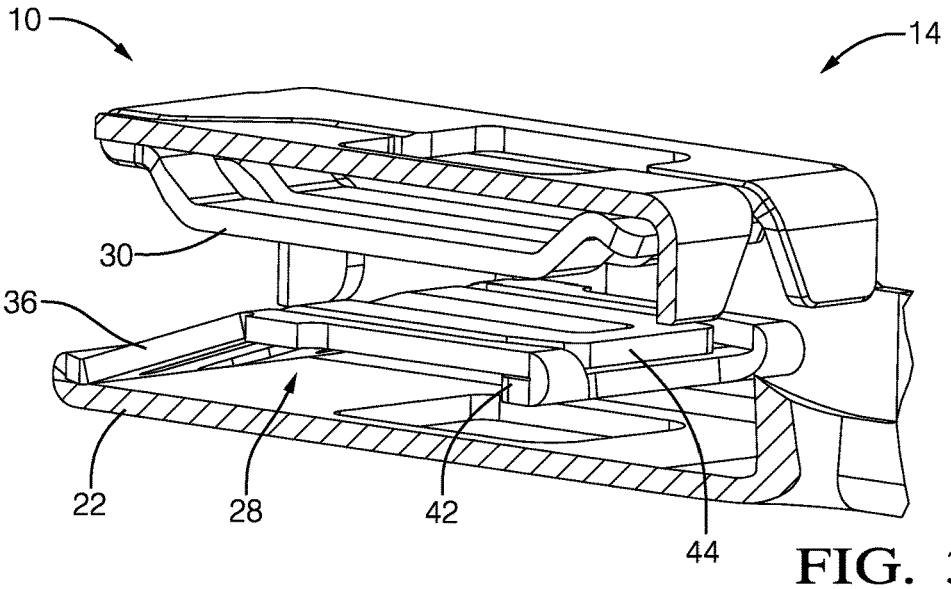
FIG. 3 another perspective section-view of the electrical-terminal of FIG. 2 in accordance with one embodiment.

FIG. 3 is another perspective section-view of the connection-end 14 of the terminal 10 of FIG. 2 and illustrates the components within the cavity 28. The lower contact-frame 36 terminates at a U-shaped tip 42 that is reversed 180-degrees, such that the tip 42 is disposed between the lower contact-frame 36 and the bottom-wall 22. That is, the tip 42 of the lower contact-frame 36 is folded back beneath the lower contact-frame 36 creating a platform.

Referring back to FIG. 2, the lower contact-frame 36 defines an inner-contact 44 disposed within a perimeter 46 of the lower contact-frame 36. The inner-contact 44 has a free-end 48 and an attached-end 50 and extends from the attached-end 50 along the mating-axis 18 and terminates at the tip 42 of the lower contact-frame 36. The free-end 48 of the inner-contact 44 is supported by the tip 42 of the lower contact-frame 36, which is more clearly illustrated in FIG. 3.

Figure 4:
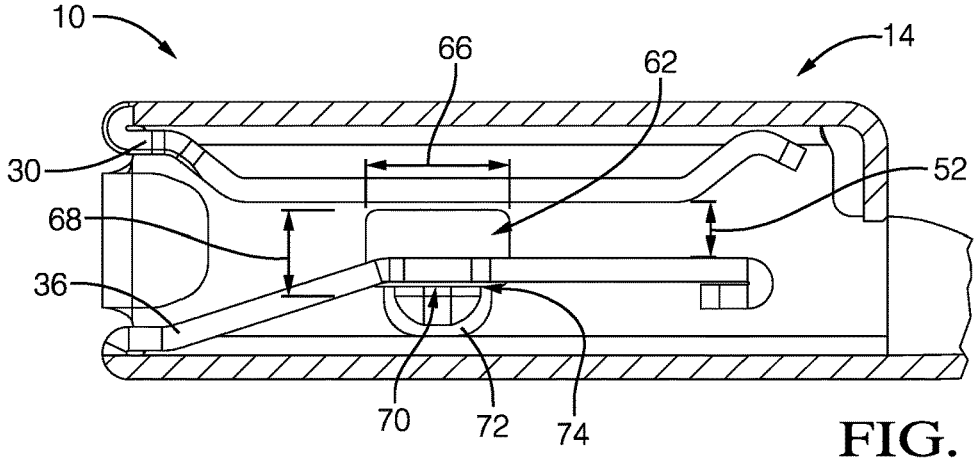
FIG. 4 is a side section-view of the electrical-terminal of FIG. 1 in accordance with one embodiment.

FIG. 4 is a side section-view of the connection-end 14 of the electrical-terminal of FIG. 1. The upper contact-frame 30 and the lower contact-frame 36 define a gap 52 between one another that is dimensioned to exert a contact-force (i.e. a normal force) on the corresponding electrical-terminal 16. The gap 52 is a critical parameter for quality and durability of the interconnection. If the gap 52 is dimensioned too small, an engagement-force 54 (see FIG. 6B) exerted on the corresponding electrical-terminal 16 by the upper contact-frame 30 and the lower contact-frame 36 may be too large and result in a damaged terminal 10 or an improper electrical connection. If the gap 52 is dimensioned too large, the contact-force on the corresponding electrical-terminal 16 may be too low and result in an intermittent electrical connection. Typically, the gap 52 is monitored during the forming process of the terminal 10 using vision systems to determine a spacing of the gap 52. Designs with narrow tolerances for the variability of the gap 52 require more tool adjustments and reduce the efficiency of the forming operation.

Figure 5:
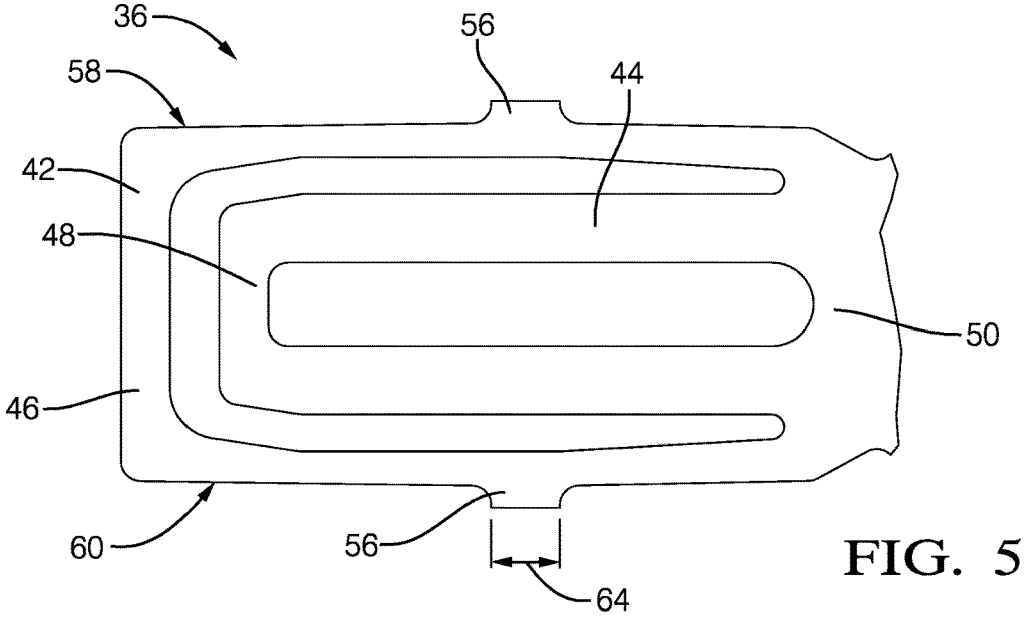
FIG. 5 illustrates a segment of the stamping blank of the electrical-terminal of FIG. 1 isolating a lower contact-frame in accordance with one embodiment.

FIG. 5 illustrates a segment of a stamping blank of the terminal 10 isolating the lower contact-frame 36 from the other features of the terminal 10. Note that the tip 42 has not yet been folded back as described above for the fully formed terminal 10. The lower contact-frame 36 includes a pair of opposed-tabs 56 extending from a left-side 58 and a right-side 60 disposed within a pair of opposed-windows 62 (see FIGS. 1 & 4) defined by the left side-wall 24 and the right side-wall 26 of the terminal 10. A tab-width 64 of the pair of opposed-tabs 56 is preferably in a range of 0.6 mm to 0.8 mm. A width 66 of the pair of opposed-windows 62 is preferably in a range of 1.0 mm to 2.0 mmm and a height 68 of the pair of opposed-windows 62 is preferably in a range of 0.6 mm to 1.0 mm, as illustrated in FIG. 4.

Referring back to FIG. 4, the pair of opposed-windows 62 defines lower-edges 70, wherein the pair of opposed-tabs 56 engage the lower-edges 70 when the corresponding electrical-terminal 16 is inserted into the gap 52, thereby inhibiting a deflection of the lower contact-frame 36. This engagement of the opposed-tabs 56 with the lower-edges 70 is beneficial because it eliminates the need for a visual inspection of the gap 52 during the forming operation, and enables location tolerances of the lower-edges 70 to control the gap 52 dimension. The gap 52 is characterized as having a spacing in a range of 0.55 mm and 0.6 mm when the opposed-tabs 56 first engage the lower-edges 70 of the pair of opposed-windows 62.

Referring again to FIG. 4, the left side-wall 24 and the right side-wall 26 define embossments 72 extending into the cavity 28. The embossments 72 define a horizontal-plane 74 formed by the lower-edges 70 of the pair of opposed-windows 62. The embossments 72 are characterized by a displacement of the left side-wall 24 and the right side-wall 26 in a range of 0.25 mm to 0.3 mm into the cavity 28.

Figure 6A:
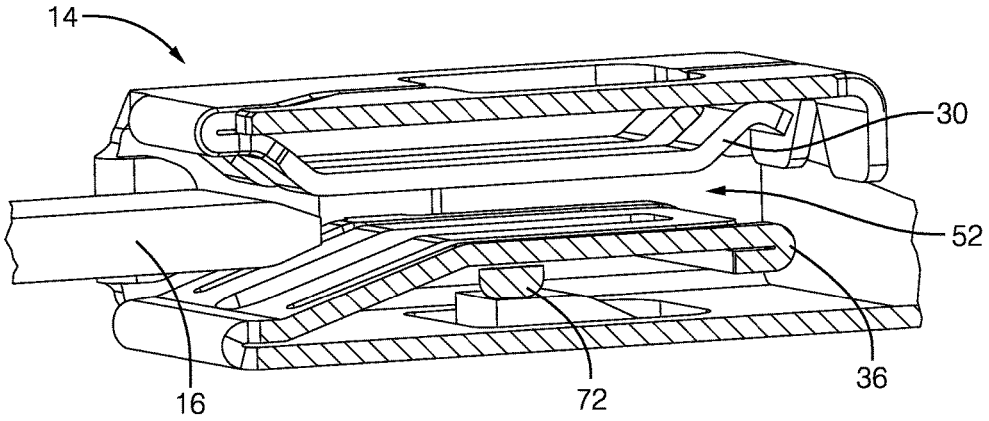
FIG. 6A illustrates a point in the insertion of a corresponding electrical-terminal into the electrical-terminal of FIG. 1 in accordance with one embodiment.
Figure 6B:
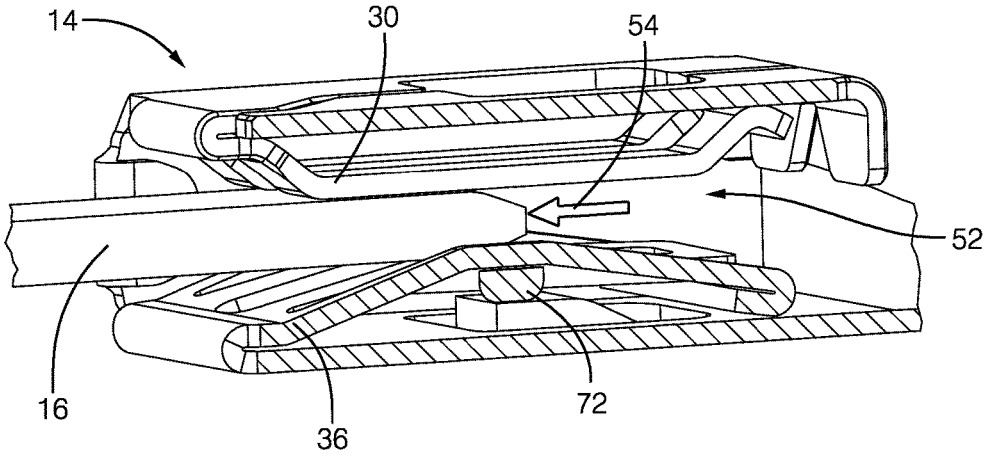
FIG. 6B illustrates another point in the insertion of a corresponding electrical-terminal into the electrical-terminal of FIG. 1 in accordance with one embodiment.

FIGS. 6A-6B illustrate a progression in a sequence of inserting the corresponding electrical-terminal 16 into the terminal 10. The corresponding electrical-terminal 16 initially engages the inner-contact 44 and the upper contact-frame 30 resulting in a first-spring-rate. As a leading-edge of the corresponding electrical-terminal 16 approaches the pair of opposed-tabs 56, the pair of opposed-tabs 56 engage the pair of opposed-windows 62 causing the perimeter 46 of the lower contact-frame 36 to flex resulting in a second spring-rate. The free-end 48 of the inner-contact 44, in combination with the engagement of the opposed-tabs 56 with the lower-edges 70 of the pair of opposed-windows 62, enables a dual spring-rate 76 behavior of the lower contact-frame 36. This dual spring-rate 76 behavior is illustrated in FIG. 6B as the corresponding electrical-terminal 16 is inserted into the gap 52. When the corresponding electrical-terminal 16 is inserted into the gap 52 the upper contact-frame 30 and the lower contact-frame 36 exert the engagement-force 54 of less than 10 Newtons on the corresponding electrical-terminal 16 under maximum tolerance conditions, and less than 5 Newtons under nominal tolerance conditions. Experimentation by the inventors has discovered that the features of the lower contact-frame 36 as described herein reduces the engagement-force 54 by between 30% to 60%. Additionally, a contact-force-to-engagement-force ratio is characterized as less than about 2:1 for the terminal 10.

Figure 7:
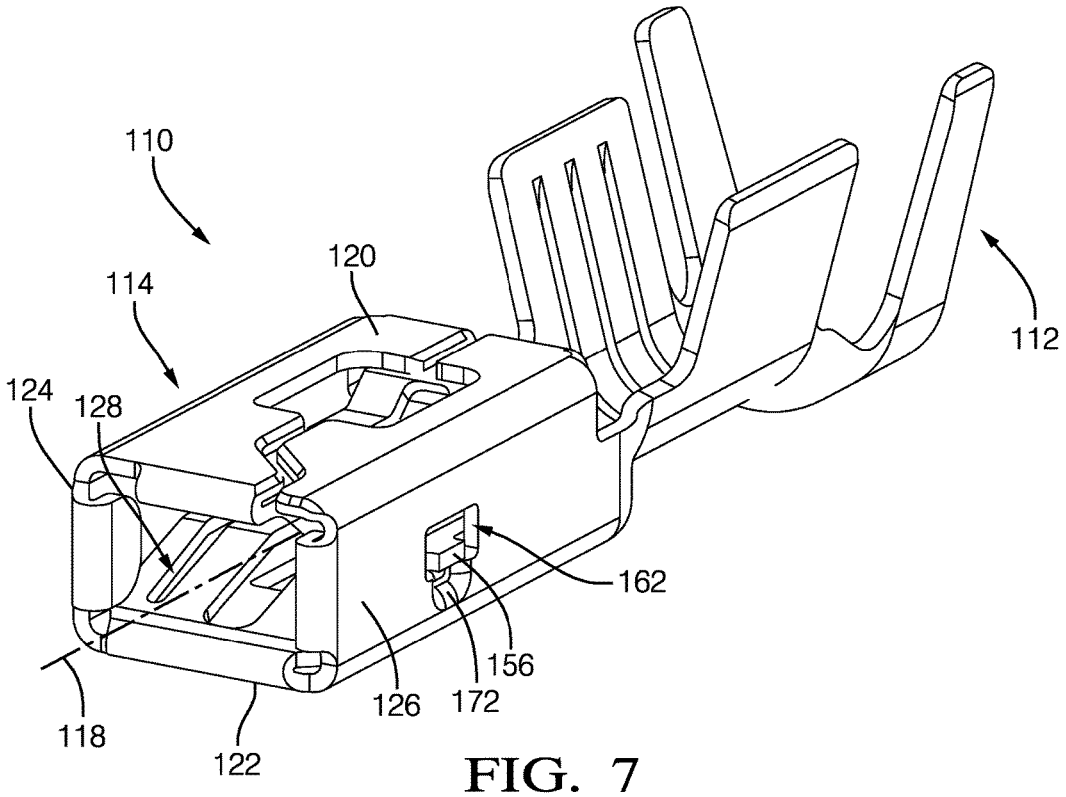
FIG. 7 is an illustration of an electrical-terminal in accordance with another embodiment.

FIG. 7 illustrates another embodiment of an electrical-terminal 110, hereafter referred to as the terminal 110. The terminal 110 is formed from a single sheet of electrically conductive material, such as a copper-based alloy, and may include a conductive coating (e.g., tin, silver, gold, etc.). The terminal 110 includes a wire-attachment-end 112 configured to receive a wire-cable (not shown) that may be a component of a wiring-harness of a vehicle. The wire-cable may be attached to the terminal 110 by any of the known processes, such as crimping and/or welding.

The terminal 110 also includes a connection-end 114 opposite the wire-attachment-end 112 configured to receive a corresponding electrical-terminal 116 (see FIGS. 12A-12B) inserted along a mating-axis 118. The connection-end 114 has a top-wall 120, a bottom-wall 122, a left side-wall 124, and a right side-wall 126 forming generally a rectilinear-shape and defining a cavity 128 that receives the corresponding electrical-terminal 116.

Figure 8:
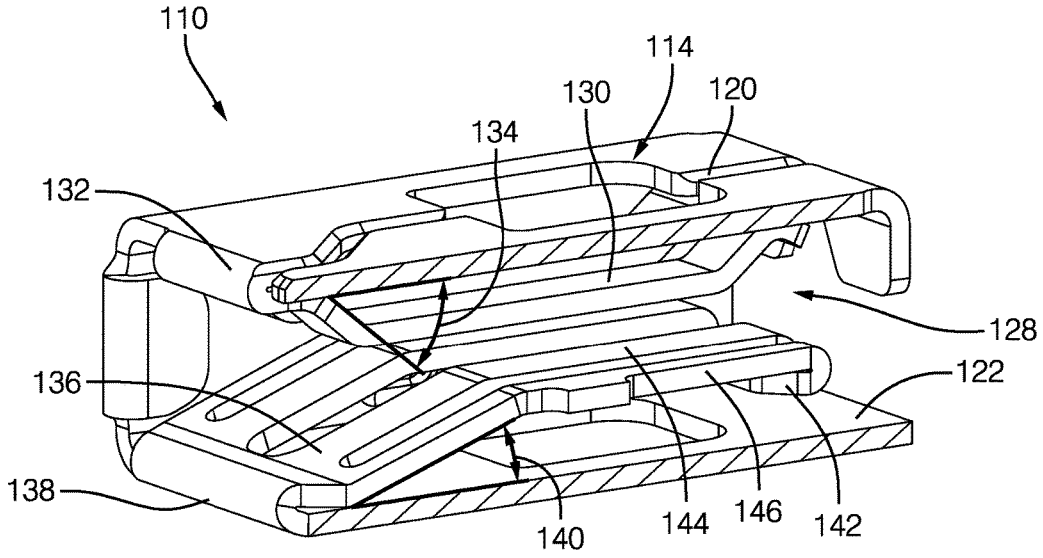
FIG. 8 is a perspective section-view of the electrical-terminal of FIG. 7 in accordance with another embodiment.

FIG. 8 is a perspective section-view of the connection-end 114 of the terminal 110 of FIG. 7 and illustrates components within the cavity 128. The connection-end 114 includes an upper contact disposed within the cavity 128 extending beyond the top-wall 120. The upper contact may be one or more protrusions embossed into the top-wall 120. In the example illustrated in FIG. 8, the upper contact is an upper contact-frame 130 disposed within the cavity 128 and attached to a top leading-edge 132 of the top-wall 120. The upper contact-frame 130 extends along the mating-axis 118 and overlays the top-wall 120. That is, the upper contact-frame 130 is folded back into the cavity 128 to create a spring contact configured to engage one side of the corresponding electrical-terminal 116. The upper contact-frame 130 defines an upper lead-angle 134, configured to guide the corresponding electrical-terminal 116 into the cavity 128, that is characterized as having a range of 30-degrees to 45-degrees.

The connection-end 114 also includes a lower contact-frame 136 disposed within the cavity 128 and attached to a bottom leading-edge 138 of the bottom-wall 122. The lower contact-frame 136 extends along the mating-axis 118 and overlays the bottom-wall 122. That is, the lower contact-frame 136 is folded back into the cavity 128 to create another spring contact configured to engage an opposite side of the corresponding electrical-terminal 116. The lower contact-frame 136 defines a lower lead-angle 140, configured to guide the corresponding electrical-terminal 116 into the cavity 128, that is characterized as having a range of 15-degrees to 30-degrees.

Figure 9:
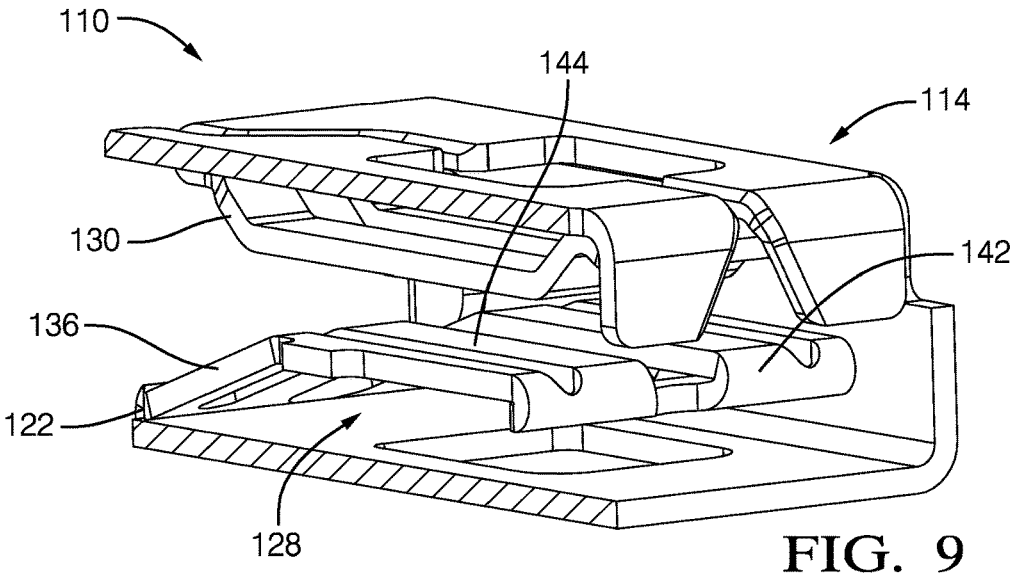
FIG. 9 another perspective section-view of the electrical-terminal of FIG. 8 in accordance with another embodiment.

FIG. 9 is another perspective section-view of the connection-end 114 of the terminal 110 of FIG. 8 and illustrates the components within the cavity 128. The lower contact-frame 136 terminates at a U-shaped tip 142 that is reversed 180-degrees, such that the tip 142 is disposed between the lower contact-frame 136 and the bottom-wall 122. That is, the tip 142 of the lower contact-frame 136 is folded back beneath the lower contact-frame 136 creating a platform. In another embodiment not shown, the tip 142 is not reversed 180-degrees.

Referring back to FIG. 8, the lower contact-frame 136 defines an inner-contact 144 disposed within a perimeter 146 of the lower contact-frame 136. The inner-contact 144 extends from the bottom leading-edge 138 along the mating-axis 118 and terminates at the tip 142 of the lower contact-frame 136.

Figure 10:
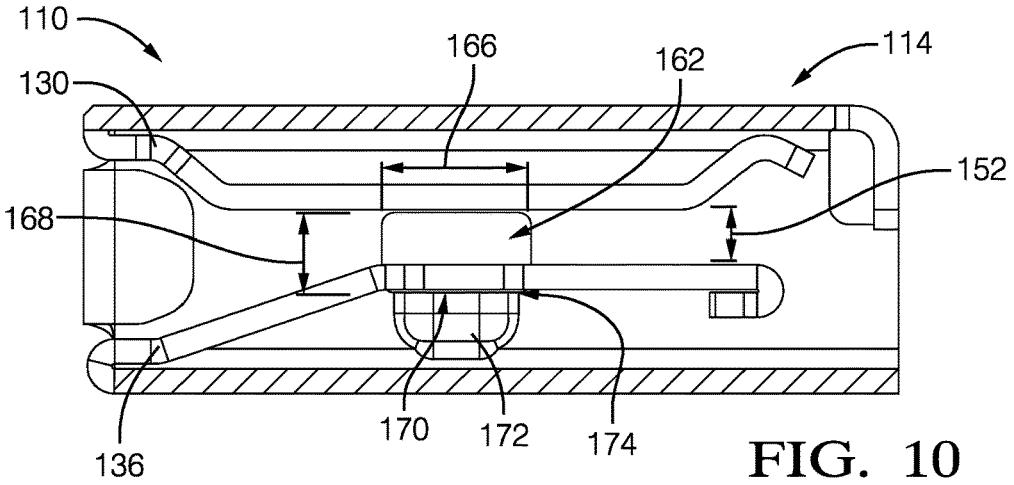
FIG. 10 is a side section-view of the electrical-terminal of FIG. 7 in accordance with another embodiment.

FIG. 10 is a side section-view of the connection-end 114 of the electrical-terminal of FIG. 7. The upper contact-frame 130 and the lower contact-frame 136 define a gap 152 between one another that is dimensioned to exert a contact-force (i.e. a normal force) on the corresponding electrical-terminal 116. The gap 152 is a critical parameter for quality and durability of the interconnection. If the gap 152 is dimensioned too small, an engagement-force 154 (see FIG. 12B) exerted on the corresponding electrical-terminal 116 by the upper contact-frame 130 and the lower contact-frame 136 may be too large and result in a damaged terminal 110 or an improper electrical connection. If the gap 152 is dimensioned too large, the contact-force on the corresponding electrical-terminal 116 may be too low and result in an intermittent electrical connection. Typically, the gap 152 is monitored during the forming process of the terminal 110 using vision systems to determine a spacing of the gap 152. Designs with narrow tolerances for the variability of the gap 152 require more tool adjustments and reduce the efficiency of the forming operation.

Figure 11:
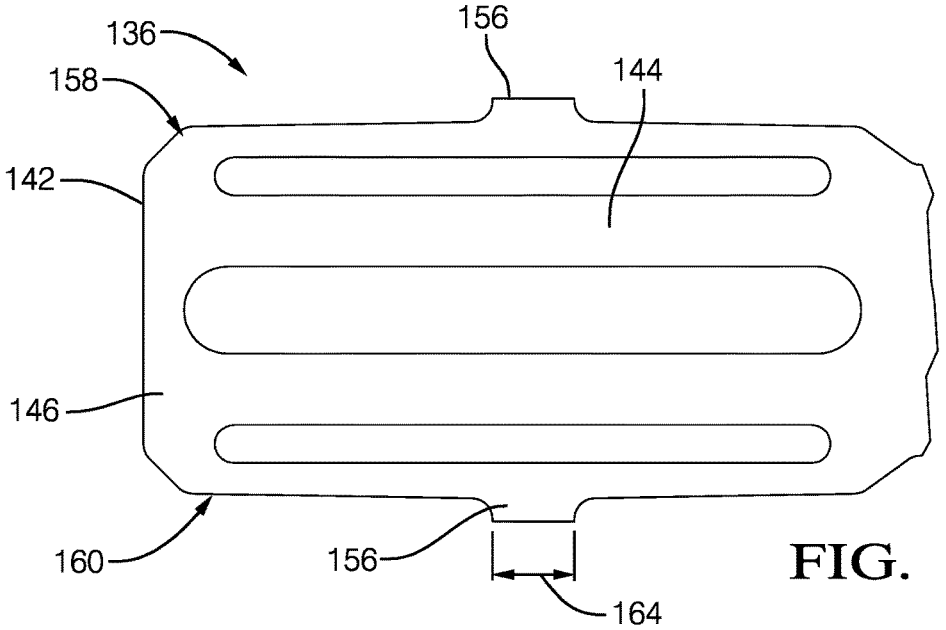
FIG. 11 illustrates a segment of the stamping blank of the electrical-terminal of FIG. 7 isolating a lower contact-frame in accordance with another embodiment.

FIG. 11 illustrates a segment of a stamping blank of the terminal 110 isolating the lower contact-frame 136 from the other features of the terminal 110. Note that the tip 142 has not yet been folded back as described above for the fully formed terminal 110. The lower contact-frame 136 includes a pair of opposed-tabs 156 extending from a left-side 158 and a right-side 160 disposed within a pair of opposed-windows 162 (see FIGS. 7 & 10) defined by the left side-wall 124 and the right side-wall 126 of the terminal 110. A tab-width 164 of the pair of opposed-tabs 156 is preferably in a range of 0.6 mm to 0.8 mm. A width 166 of the pair of opposed-windows 162 is preferably in a range of 1.0 mm to 2.0 mmm and a height 168 of the pair of opposed-windows 162 is preferably in a range of 0.6 mm to 1.0 mm, as illustrated in FIG. 10.

Referring back to FIG. 10, the pair of opposed-windows 162 defines lower-edges 170, wherein the pair of opposed-tabs 156 engage the lower-edges 170 when the corresponding electrical-terminal 116 is inserted into the gap 152, thereby inhibiting a deflection of the lower contact-frame 136. This engagement of the opposed-tabs 156 with the lower-edges 170 is beneficial because it eliminates the need for a visual inspection of the gap 152 during the forming operation, and enables location tolerances of the lower-edges 170 to control the gap 152 dimension. The gap 152 is characterized as having a spacing in a range of 0.55 mm and 0.6 mm when the opposed-tabs 156 first engage the lower-edges 170 of the pair of opposed-windows 162.

Referring again to FIG. 10, the left side-wall 124 and the right side-wall 126 define embossments 172 extending into the cavity 128. The embossments 172 define a horizontal-plane 174 formed by the lower-edges 170 of the pair of opposed-windows 162. The embossments 172 are characterized by a displacement of the left side-wall 124 and the right side-wall 126 in a range of 0.25 mm to 0.3 mm into the cavity 128.

Figure 12A:
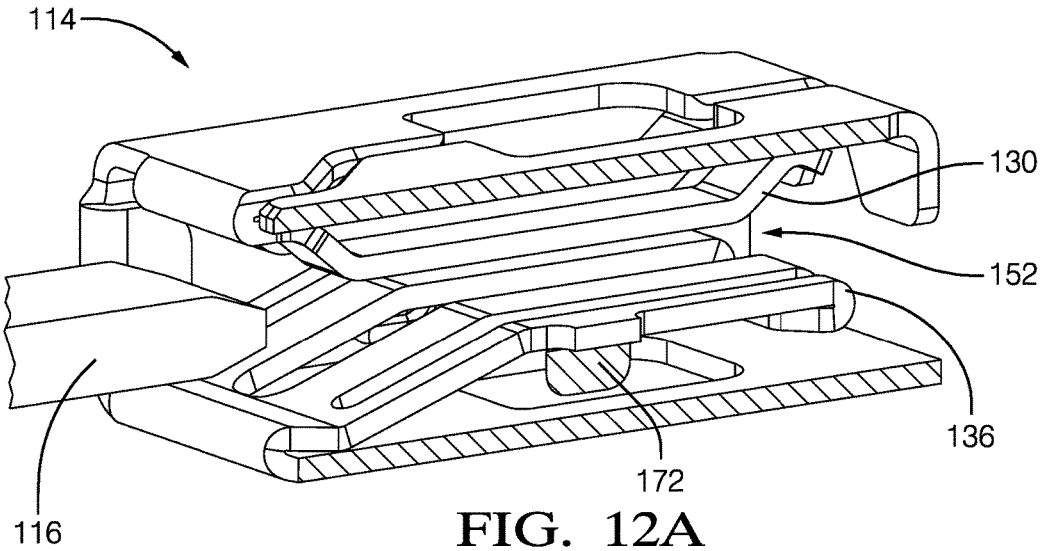
FIG. 12A illustrates a point in the insertion of a corresponding electrical-terminal into the electrical-terminal of FIG. 7 in accordance with another embodiment.
Figure 12B:
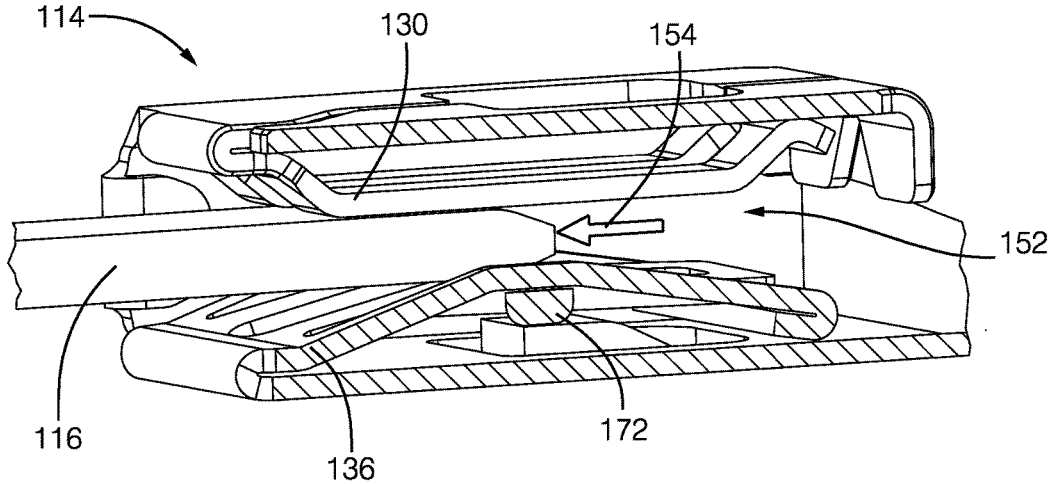
FIG. 12B illustrates another point in the insertion of a corresponding electrical-terminal into the electrical-terminal of FIG. 7 in accordance with another embodiment.

FIGS. 12A-12B illustrate a progression in a sequence of inserting the corresponding electrical-terminal 116 into the terminal 110. The corresponding electrical-terminal 116 initially engages the inner-contact 144 and the upper contact-frame 130 resulting in a first-spring-rate. As a leading-edge of the corresponding electrical-terminal 116 approaches the pair of opposed-tabs 156, the pair of opposed-tabs 156 engage the pair of opposed-windows 162 causing the perimeter 146 of the lower contact-frame 136 to flex resulting in a second spring-rate. The inner-contact 144, in combination with the engagement of the opposed-tabs 156 with the lower-edges 170 of the pair of opposed-windows 162, enables a dual spring-rate 176 behavior of the lower contact-frame 136. This dual spring-rate 176 behavior is illustrated in FIG. 12B as the corresponding electrical-terminal 116 is inserted into the gap 152. When the corresponding electrical-terminal 116 is inserted into the gap 152 the upper contact-frame 130 and the lower contact-frame 136 exert the engagement-force 154 of less than 15 Newtons on the corresponding electrical-terminal 116. Additionally, a contact-force-to-engagement-force ratio is characterized as less than about 2:1 for the terminal 110.

Accordingly, an electrical-terminal 10, 110, is provided. The terminal 10, 110 is an improvement over prior art electrical terminals because the features of the terminal 10, 110, reduce the engagement-force 54, 154 and control the gap 52, 152 between the upper contact-frame 30, 130 and the lower contact-frame 36, 136.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. An electrical-terminal, comprising:

a wire-attachment-end configured to receive a wire-cable; and a connection-end opposite the wire-attachment-end, said connection-end having a top-wall, a bottom-wall, a left side-wall, and a right side-wall forming generally a rectilinear-shape and defining a cavity configured to receive a corresponding electrical-terminal inserted along a mating-axis;

said connection-end including an upper contact and a lower contact-frame disposed within the cavity;

said lower contact-frame attached to a bottom leading-edge of the bottom-wall extending along the mating-axis and overlaying the bottom-wall;

said lower contact-frame terminating at a tip;

said lower contact-frame defining an inner-contact disposed within a perimeter of the lower contact-frame;

said inner-contact having a free-end, a first side, a second side, and an attached-end;

said inner-contact extending from the attached-end along the mating-axis and terminating at the tip of the lower contact-frame;

said attached-end attached to the bottom leading-edge of the bottom-wall; wherein said free-end, first side, and second side are spaced and separated from the perimeter of the lower contact-frame; wherein the upper contact has an upper contact-frame disposed within the cavity and attached to a top leading-edge of the top-wall extending along the mating-axis and overlaying the top-wall.

2. The electrical-terminal in accordance with claim 1, wherein when the corresponding electrical-terminal is inserted into the gap the upper contact-frame and the lower contact-frame exert an engagement-force of less than 10 Newtons on the corresponding electrical-terminal.

3. The electrical-terminal in accordance with claim 2, wherein when the corresponding electrical-terminal is inserted into the gap the upper contact-frame and the lower contact-frame exert the engagement-force of less than 5 Newtons on the corresponding electrical-terminal.

4. The electrical-terminal in accordance with claim 1, wherein the free-end of the inner-contact is supported by the tip of the lower contact-frame.

5. The electrical-terminal in accordance with claim 4, wherein the lower contact-frame has a dual spring-rate, wherein a flexure of the lower contact-frame defines a first-spring-rate and the flexure of the perimeter of the lower contact-frame defines a second spring-rate.

6. The electrical-terminal in accordance with claim 1, wherein the left side-wall and the right side-wall define embossments extending into the cavity, said embossments defining a horizontal-plane formed by the lower-edges of the pair of opposed-windows.

7. The electrical-terminal in accordance with claim 6, wherein the embossments have a displacement of the left side-wall and the right side-wall in a range of 0.25 mm to 0.30 mm.

8. The electrical-terminal in accordance with claim 1, wherein a width of the pair of opposed-windows is in a range of 1.0 mm to 2.0 mm, and wherein a height of the pair of opposed-windows is in a range of 0.6 mm to 1.0 mm.

9. The electrical-terminal in accordance with claim 1, wherein a tab-width of the pair of opposed-tabs is in a range of 0.6 mm to 0.8 mm.

10. The electrical-terminal in accordance with claim 1, wherein a lower lead-angle of the lower contact-frame is in a range of 15-degrees to 30-degrees.

11. The electrical-terminal in accordance with claim 1, wherein the gap has a spacing in a range of 0.55 mm and 0.6 mm.

12. The electrical-terminal in accordance with claim 1, wherein a contact-force-to-engagement-force ratio is less than about 2:1.

13. The electrical-terminal in accordance with claim 1 wherein the tip of the lower contact-frame is reversed 180-degrees such that the tip is disposed between the lower contact-frame and the bottom-wall.

14. The electrical-terminal in accordance with claim 1 wherein the lower contact-frame includes a pair of opposed-tabs extending from a left-side and a right-side.

15. The electrical-terminal in accordance with claim 14 wherein the pair of opposed-tabs extend into a pair of opposed-windows defined by the left side-wall and the right side-wall.

16. The electrical-terminal in accordance with claim 15 wherein the pair of opposed-windows define lower-edges, wherein the pair of opposed-tabs engage the lower-edges when the corresponding electrical-terminal is inserted into the gap, thereby inhibiting a deflection of the lower contact-frame.

17. An electrical-terminal, comprising:

a wire-attachment-end configured to receive a wire-cable; and a connection-end opposite the wire-attachment-end, said connection-end having a top-wall, a bottom-wall, a left side-wall, and a right side-wall forming generally a rectilinear-shape and defining a cavity configured to receive a corresponding electrical-terminal inserted along a mating-axis;

said connection-end including an upper contact and a lower contact-frame disposed within the cavity;

said lower contact-frame attached to a bottom leading-edge of the bottom-wall extending along the mating-axis and overlaying the bottom-wall;

said lower contact-frame terminating at a tip;

said lower contact-frame defining an inner-contact disposed within a perimeter of the lower contact-frame;

said inner-contact extending from the bottom leading-edge along the mating-axis and terminating at the tip of the lower contact-frame; wherein said inner-contact has a first side and a second side, said first side and second side spaced and separated from the perimeter of the lower contact-frame; wherein the upper contact has an upper contact-frame disposed within the cavity and attached to a top leading-edge of the top-wall extending along the mating-axis and overlaying the top-wall.

18. The electrical-terminal in accordance with claim 17, wherein when the corresponding electrical-terminal is inserted into the gap the upper contact-frame and the lower contact-frame exert an engagement-force of less than 15 Newtons on the corresponding electrical-terminal.

19. The electrical-terminal in accordance with claim 17, wherein the lower contact-frame has a dual spring-rate, wherein a flexure of the lower contact-frame defines a first-spring-rate and the flexure of the perimeter of the lower contact-frame defines a second spring-rate.

20. The electrical-terminal in accordance with claim 17, wherein the left side-wall and the right side-wall define embossments extending into the cavity, said embossments defining a horizontal-plane formed by the lower-edges of the pair of opposed-windows.

21. The electrical-terminal in accordance with claim 17, wherein an engagement-force to friction-force ratio is less than about 2:1.

22. The electrical-terminal in accordance with claim 13 wherein a portion of the reversed tip of the lower contact-frame is in direct contact with a bottom surface of the lower contact-frame.

23. The electrical-terminal in accordance with claim 17 wherein the tip of the lower contact-frame is reversed 180-degrees such that the tip is disposed between the lower contact-frame and the bottom-wall.

24. The electrical-terminal in accordance with claim 23 wherein a portion of the reversed tip of the lower contact-frame is in direct contact with a bottom surface of the lower contact-frame.

25. The electrical-terminal in accordance with claim 17 wherein the lower contact-frame includes a pair of opposed-tabs extending from a left-side and a right-side.

26. The electrical-terminal in accordance with claim 25 wherein the pair of opposed-tabs extend into a pair of opposed-windows defined by the left side-wall and the right side-wall.

27. The electrical-terminal in accordance with claim 26 wherein the pair of opposed-windows define lower-edges, wherein the pair of opposed-tabs engage the lower-edges when the corresponding electrical-terminal is inserted into the gap, thereby inhibiting a deflection of the lower contact-frame.

* * * * *